US005667633A

United States Patent [19]

Pettersson et al.

[11] Patent Number: 5,667,633

[45] Date of Patent: Sep. 16, 1997

[54] METHOD OF PRODUCING WHITE LIQUOR STREAMS OF HIGH AND LOW SULPHIDITY

[75] Inventors: Bertil Pettersson; Bertil Granqvist; Ingemar Eriksson, all of Gävle, Sweden

[73] Assignee: Korsnas AB, Sweden

[21] Appl. No.: 549,770

[22] PCT Filed: Jun. 3, 1994

[86] PCT No.: PCT/SE94/00537

§ 371 Date: Dec. 1, 1995

§ 102(e) Date: Dec. 1, 1995

[87] PCT Pub. No.: WO94/29516

PCT Pub. Date: Dec. 22, 1994

[30] Foreign Application Priority Data

Jun. 4, 1993 [SE] Sweden ..... 9301921

[51] Int. Cl.[6] ..... D21C 11/04

[52] U.S. Cl. ..... 162/30.11; 162/30.1; 162/35; 423/183

[58] Field of Search ..... 162/29, 30.1, 30.11, 162/31, 35; 423/183, DIG. 3

[56] References Cited

U.S. PATENT DOCUMENTS 1,560,900 11/1925 Drewsen .
1,743,080 3/1930 Bradley et al. .
3,336,535 8/1967 Cann ..... 162/30
4,941,945 7/1990 Pettersson ..... 162/29

FOREIGN PATENT DOCUMENTS 2 550 245 2/1985 France .
WO92/20856 11/1992 WIPO .

OTHER PUBLICATIONS

K. Salmenoja, "Development of Black Liquor Gasification", 1993 Engineering Conference, pp. 969–975.

*Primary Examiner*—Donald E. Czaja
*Assistant Examiner*—Dean T. Nguyen
*Attorney, Agent, or Firm*—Bacon & Thomas

[57] ABSTRACT

A method of producing white liquor having enhanced and/or reduced sulphidity in the recovery of chemicals in a sulphate pulp process is described. In the method one starts from a calcium sulphide rich smelt of inorganic chemicals, which has been obtained by simultaneous combustion of black liquor and processing of lime sludge. This smelt is treated with an aqueous solution, whereupon the calcium sulphide in the smelt is present in a solid form and the rest of the chemicals are in solution. Thereupon the solid calcium sulphide is separated and the obtained solution is processed as a green liquor in per se known manner to a white liquor having reduced sulphidity, whereupon optionally the separated solid calcium sulphide is mixed with the required amount of white liquor to a white liquor having enhanced sulphidity.

5 Claims, No Drawings

METHOD OF PRODUCING WHITE LIQUOR STREAMS OF HIGH AND LOW SULPHIDITY

The present invention relates to the production of white liquor in the recovery of chemicals in a sulphate pulp process. More precisely, the invention relates to the production of white liquor having enhanced and/or reduced sulphidity starting from a calcium sulphide rich smelt of inorganic chemicals, which has been obtained by simultaneous combustion of black liquor and processing of lime sludge.

The production of a calcium sulphide rich smelt of inorganic chemicals in connection with simultaneous combustion of black liquor and processing of lime sludge has been described in the simultaneously filed patent application having the title "Combustion of black liquor".

BACKGROUND

In the production of pulp according to the sulphate pulp method wood, in the form of chips, is delignified in an alkaline solution, which mainly consists of NaOH and NaHS, in a pressurized cooking process, which in the final stage normally has a temperature in the range of 150°–175° C. The ratio of hydroxide ions $[OH^-]$ to $[HS^-]$ is normally within the range of 25–40% sulphide $[2HS^-]$, calculated on the sum of the contents of sulphide ions and hydroxide ions.

An increased content of sulphide ions in relation to hydroxide ions in the cooking liquor increases the yield of pulp and, normally, improves the important properties of the final product. In the beginning of the cooking process, the so called impregnation stage, an increased proportion of sulphide ions forms the bases of a more efficient release of lignin during the actual cooking process. A simultaneous reduction of the contents of hydroxide ions decreases the degradation of cellulose, which results in an increased yield and higher quality of the final product.

The present invention provides a white liquor having enhanced sulphidity, which can be utilized in the above mentioned cooking process.

Further, the invention provides white liquor having reduced sulphidity. White liquor having reduced sulphidity may e.g. be used as a chemical in the production of bleached wood pulp.

DESCRIPTION OF THE INVENTION

The present invention provides a method of producing white liquor having enhanced and/or reduced sulphidity in the recovery of chemicals in a sulphate pulp process. The method implies that a calcium sulphide rich smelt of inorganic chemicals, which has been obtained by simultaneous combustion of black liquor and processing of lime sludge, is treated with an aqueous solution, whereupon the calcium sulphide in the smelt is present in solid form and the rest of the chemicals are present in solution, after which the solid calcium sulphide is separated, and a) the obtained solution is processed as a green liquor in a per se known manner to a white liquor having reduced sulphidity, whereupon optionally
b) the separated solid calcium sulphide (CaS) is mixed with a required amount of white liquor, the $[OH^-]$ of the white liquor reacting with CaS according to the reaction formula $$CaS_{(s)}+H_2O+[2OH^-]\rightarrow Ca(OH)_{2(s)}+[HS^-]+[OH^-]$$

to a white liquor having enhanced sulphidity and solid $Ca(OH)_2$, which is separated.

As initially indicated a calcium sulphide rich smelt of inorganic chemicals may be obtained when combustion of black liquor and processing of lime sludge are performed simultaneously, which is described in a patent application having the title "Combustion of black liquor" which is filed simultaneously with the present application.

The combustion may have taken place in a liquor combustion plant, which can be a conventional recovery boiler, but can also be a liquor gasification plant.

By the expression "the obtained solution is processed as a green liquor in per se known manner to a white liquor having reduced sulphidity" is meant in the specification and the appended claims that the obtained solution is processed in the same way as is known for processing of green liquor to white liquor. By "enhanced sulphidity" and "reduced sulphidity" is intended a comparison with the sulphidity of white liquor that has been previously produced in a conventional manner.

In one embodiment of the method according to the invention the solid $Ca(OH)_2$ separated in the method is further processed by addition thereof, after separation of the solid sulphide, to the obtained solution, and this is processed by causticizing according to the reaction formula $$Ca(OH)_{2(s)}+[CO_3^{2-}]\rightarrow CaCO_{3(s)}+[2OH^-]$$

and the solid $CaCO_{3(s)}$, the lime sludge, is separated, whereby white liquor having reduced sulphidity is obtained.

In another embodiment of the invention the aqueous solution used in the method is water. According to still another embodiment the aqueous solution is weak liquor. Weak liquor is a weakly alkaline solution which has been obtained e.g. in the washing of separated lime sludge ($CaCO_3$) in conventional causticizing.

According to yet another embodiment of the invention the solid sulphide is separated by filtration.

Description of recovery of chemicals in a sulphate pulp process by use of the invention In a sulphate pulp process the main part of the cooking chemicals are found together with organic materials dissolved from wood in the black liquor (recycled liquor), which after evaporation to combustible dry solids content is burnt in a liquor combustion plant, which normally is a recovery boiler, but which also can be a liquor gasification plant.

In the liquor combustion process the main part of the cooking chemicals are recovered from a smelt which is formed by the combustion and which then is transported to a dissolver for dissolution in a weakly alkaline solution (weak liquor). (The weak liquor has normally been obtained from the washing of lime sludge ($CaCO_3$), which has been separated in the causticizing plant).

The alkaline solution (green liquor) which is obtained in the soda dissolver mainly contains sodium compounds, the available sulphide being to 90–95% in the form of NaHS, and the remaining amount sodium being mainly in the form of $Na_2CO_3$.

The green liquor is usually cleaned from solid process substances and is thereafter added to the causticizing process, where burnt lime (CaO) is added in such an amount that 80–85% of $Na_2CO_3$ is converted to NaOH according to the formula:

$$Na_2CO_{3(1)}+H_2O+CaO_{(s)} \leftrightharpoons 2NaOH_{(1)}+CaCO_{3(s)}$$

After separation of the solid $CaCO_3$ (lime sludge) is formed, a strong alkaline solution (white liquor) is obtained, the active chemicals for the cooking process of which are NaHS and NaOH. The sulphidity of the white liquor, i.e. the ratio between sulphide ions and hydroxide ions, is mainly determined by the ratio $S/Na_2$ in the dissolved smelt of inorganic chemicals from the liquor combustion plant.

In certain liquor evaporation processes the combustion will occur in such a way that the sulphide is mainly obtained in the gaseous phase as hydrogen sulphide ($H_2S$) and is separated in a gas cleaning plant by scrubbing with an alkaline solution, so that the cleaned gas contains low contents of sulphide prior to combustion in the gas furnace. The alkaline solution to the scrubber can either consist of hydroxide or carbonate, and in either case the need of burnt lime (CaO) is increased more than would be needed if NaSH was obtained in conventional manner from $Na_2S$ in a smelt of chemicals from a recovery boiler. The increase in the need of burnt lime is related to the amount of $H_2S$ that is taken up by the scrubber liquid.

Scrubbing:

$$H_2S_{(g)}+OH^- \leftrightharpoons HS^-+H_2O$$

or $$H_2S_{(g)}+CO_3^{2-} \leftrightharpoons HS^-+HCO_3^-$$

Slaking:

$$CaO_{(s)}+H_2O \leftrightharpoons Ca(OH)_{2(s)}$$

Neutralizing:

$$Ca(OH)_{2(s)}+2HCO_3^- \leftrightharpoons CaCO_{3(s)}+CO_3^{2-}+2H_2O$$

Causticizing:

$$Ca(OH)_{2(s)}+CO_3^{2-} \leftrightharpoons Ca(CO_{3(s)}+2OH^-$$

The calcium sulphide rich smelt of inorganic chemicals which is used in the present invention derives from simultaneous combustion of black liquor and processing of lime sludge ($CaCO_3$).

Irrespective of whether this has occurred in a recovery boiler or a liquor evaporator the inorganic chemicals are obtained in melted form, where the following reactions occur in the presence of $CaCO_3$:

$$CaCO_3+Na_2S \rightarrow CaS+Na_2CO_3 > 600° C. \quad 1.$$

$$CaS+Na_2CO_3 \rightarrow CaO+Na_2S+CO_2 > 800° C. \quad 2.$$

$$CaO+Na_2S \rightarrow CaS+Na_2O < 800° C. \quad 3.$$

The indicated temperatures are very approximate and may, depending on different circumstances, vary by e.g. ±70° C.

In a liquor evaporator which works in a temperature range where the sulphide normally leaves the evaporator in the form of $H_2S$ and the rest of the inorganic chemicals in solid form, the sulphide will be obtained in the form of CaS if $CaCO_3$ is supplied to the black liquor in the molar ratio of S/Ca=1, and the CaS leaves the evaporator in solid form like the rest of the inorganic chemicals. In the liquor evaporator the reaction will occur according to the formula 1 above.

If weak liquor is used as aqueous solution in the treatment of calcium sulphide rich smelt according to the invention the CaS will be in solid form, if the content of $[OH^-]$ in the solution is so high that CaS will be converted to NaHS or $Na_2S$ in the dissolver, which is not the case if the content of $Na_2S$ in the smelt of chemical from the combustion plant is low or if the solid CaS is separated before it is converted to $Na_2S$.

If the aqueous solution that is used in the present invention for treatment of the calcium sulphide rich smelt is water the solution will indeed be slightly alkaline, but the risk of CaS being converted to $Na_2S$ before it is separated in solid form is considerably reduced or totally eliminated.

CaS is separated, e.g. by filtration, and the purified, $Na_2CO_3$ rich solution is transported to the causticizing plant, where a white liquor having reduced (low) content of $[HS^-]$ is obtained.

The separated CaS is mixed with a required amount of the white liquor produced or another white liquor, e.g. in a reaction vessel, whereby the $[OH^-]$ of the white liquor reacts with CaS according to the formula:

$$CaS_{(s)}+H_2O+[2OH^-] \rightarrow Ca(OH)_{2(s)}+[HS^-]+[OH^-] \quad 4.$$

The solid phase ($Ca(OH)_2$) is separated e.g. by filtration, whereby a white liquor having enhanced (high) sulphidity is obtained.

The separated solid phase, $Ca(OH)_2$, may then be recycled to a green liquor and causticized according to the formula:

$$Ca(OH)_{2(s)}+[CO_3^{2-}] \rightarrow CaCO_{3(s)}+[2OH^-] \quad 5.$$

The solid lime sludge ($CaCO_3$) which thereby arises is separated, e.g. in a filtration plant, and may be recycled, after washing, to the combustion plant, where it may be burnt together with black liquor. Upon separation of the lime sludge, a white liquor having reduced (low) content of $[HS^-]$ is obtained.

From the formula 5 above, it is evident that $[OH^-]$, which has been consumed in the production of white liquor having enhanced sulphidity according to the invention, formula 4, has been re-created by the causticizing, without any need of additional burnt lime (CaO). Thus, the production of white liquor having enhanced and/or reduced sulphidity can be produced without an increase in the amount of burnt lime.

What is claimed is:

1. A method of producing two types of white liquor in the recovery of chemicals in a sulphate pulp process, a first type having enhanced sulphidity and a second type having reduced sulphidity comprising the steps of a) providing a calcium sulphide rich smelt of inorganic chemicals resulting from simultaneous combustion of black liquor and processing of lime sludge, b) treating said calcium sulphide rich smelt with an aqueous solution to yield a mixture wherein the calcium sulphide is in solid form and the rest of the chemicals are in solution, c) separating the solid calcium sulphide from the mixture to yield a solution, d) processing the solution as green liquor by causticization according to the reaction formula $$Ca(OH)_{2(S)}+[CO_3^{2-}]\rightarrow CaCO_{3(S)}+[2\ OH]$$

followed by separation of the solid $CaCO_{3(S)}$, the lime sludge, to yield said first type of white liquor having reduced sulphidity, e) mixing the solid calcium sulphide (CaS) obtained in step c) with a required amount of white liquor to react the $[OH^-]$ of the white liquor with the CaS according to the reaction formula $$CaS_{(S)}+[H_2O]+[2\ OH^-]\rightarrow Ca(OH)_{2(S)}+[HS^-]+[OH^-]$$

f) separating the solid $Ca(OH)_2$ from the mixture obtained in step e) to yield the second type of white liquor having enhanced sulphidity.

2. The method according to claim 1, wherein the solid $Ca(OH)_2$ obtained in step f) is added in the step d) to the solution for processing.

3. The method according to claim 1, wherein the aqueous solution in step b) is water.

4. The method according to claim 1, wherein the aqueous solution in step b) is weak liquor.

5. The method according to claim 1, wherein the separation in step c) of the solid calcium sulphide is performed by filtration.

* * * * *